US011519615B2

(12) United States Patent
Martinez Galvan

(10) Patent No.: US 11,519,615 B2
(45) Date of Patent: Dec. 6, 2022

(54) OUTDOOR UNIT OF AN AIR CONDITIONER

(71) Applicant: Electrolux Appliances Aktiebolag, Stockholm (SE)

(72) Inventor: Israel Martinez Galvan, Stockholm (SE)

(73) Assignee: Electrolux Appliances Aktiebolag

( * ) Notice: Subject to any disclaimer, the term of this patent is extended or adjusted under 35 U.S.C. 154(b) by 160 days.

(21) Appl. No.: 16/771,107

(22) PCT Filed: Dec. 13, 2017

(86) PCT No.: PCT/EP2017/082615
§ 371 (c)(1),
(2) Date: Jun. 9, 2020

(87) PCT Pub. No.: WO2019/114945
PCT Pub. Date: Jun. 20, 2019

(65) Prior Publication Data

US 2020/0333021 A1 Oct. 22, 2020

(51) Int. Cl.

| | |
|---|---|
| ***F24F 1/48*** | (2011.01) |
| ***F24F 11/89*** | (2018.01) |
| ***F24F 1/10*** | (2011.01) |
| ***F24F 1/16*** | (2011.01) |
| ***F24F 1/22*** | (2011.01) |

(Continued)

(52) U.S. Cl.
CPC ..... *F24F 1/48* (2013.01); *F24F 1/10* (2013.01); *F24F 1/16* (2013.01); *F24F 1/22* (2013.01); *F24F 1/38* (2013.01); *F24F 1/56* (2013.01); *F24F 11/89* (2018.01); *F24F 13/20* (2013.01);

(Continued)

(58) Field of Classification Search
CPC ..... F24F 2013/207; F24F 1/48; F24F 11/89; F24F 1/10; F24F 1/16; F24F 1/22; F24F 1/38; F24F 1/56; F24F 13/20; F24F 13/30; F24F 2013/202
See application file for complete search history.

(56) References Cited

U.S. PATENT DOCUMENTS

| | | | |
|---|---|---|---|
| 399,491 | A | 3/1889 | Bukawietis |
| 1,954,017 | A | 4/1934 | Manning |

(Continued)

FOREIGN PATENT DOCUMENTS

| | | | |
|---|---|---|---|
| CN | 2190590 | Y | 3/1995 |
| CN | 2413205 | Y | 1/2001 |

(Continued)

OTHER PUBLICATIONS

WO-2014188526-A1 Translation (Year: 2014).*

(Continued)

*Primary Examiner* — Schyler S Sanks
(74) *Attorney, Agent, or Firm* — RatnerPrestia

(57) ABSTRACT

An outdoor unit of an air-conditioner. The outdoor unit has a casing having a front air outlet and at least one air inlet. At least one fan is located in the casing. The outdoor unit is configured such that the at least one air inlet is provided in a top section and or in a bottom section of the outdoor unit when the outdoor unit is installed in an operational position. The outdoor unit is further configured such that the at least one fan is configured to move air from the at least one air-inlet to the front air outlet or move air from front air outlet to the at least one air-inlet.

14 Claims, 5 Drawing Sheets

(51) Int. Cl.

| | |
|---|---|
| ***F24F 1/38*** | (2011.01) |
| ***F24F 1/56*** | (2011.01) |
| ***F24F 13/20*** | (2006.01) |
| ***F24F 13/30*** | (2006.01) |
| ***F24F 1/32*** | (2011.01) |

(52) U.S. Cl.
CPC ..... *F24F 13/30* (2013.01); *F24F 1/32* (2013.01); *F24F 2013/202* (2013.01)

(56) References Cited

U.S. PATENT DOCUMENTS

| | | | |
|---|---|---|---|
| 2,234,753 | A | 3/1941 | Frazer |
| 2,268,451 | A | 12/1941 | Hull |
| 2,320,436 | A | 6/1943 | Hull |
| 2,436,713 | A | 2/1948 | Cody |
| 2,568,968 | A | 9/1951 | Perrin |
| 2,608,148 | A | 8/1952 | Shapiro |
| 2,708,833 | A | 5/1955 | Nigro |
| 2,814,244 | A | 11/1957 | Hord |
| 2,818,793 | A | 1/1958 | Hord |
| 2,925,026 | A | 2/1960 | Schuster et al. |
| 2,935,284 | A | 5/1960 | Reeves |
| 3,030,873 | A | 4/1962 | Metcalfe |
| 3,134,319 | A | 5/1964 | Marsteller |
| 3,476,033 | A | 11/1969 | Appel |
| 3,481,264 | A | 12/1969 | Ulich |
| 3,491,549 | A | 1/1970 | Oglesby |
| 3,552,470 | A | 1/1971 | Metcalfe |
| 3,554,476 | A | 1/1971 | Gaylor, Jr. |
| 3,698,208 | A | 10/1972 | Navara |
| 3,698,308 | A | 10/1972 | Navaro |
| 3,911,803 | A | 10/1975 | Kong et al. |
| 4,086,886 | A | 5/1978 | Edmaier et al. |
| 4,152,844 | A | 5/1979 | Materniak et al. |
| 4,203,302 | A | 5/1980 | Lapeyre |
| 4,334,461 | A | 6/1982 | Ferguson et al. |
| 5,027,614 | A | 7/1991 | Mori et al. |
| 5,167,131 | A | 12/1992 | Karkhanis |
| 5,290,343 | A | 3/1994 | Morita et al. |
| 5,365,992 | A | 11/1994 | Swain et al. |
| 5,582,025 | A | 12/1996 | Dubin et al. |
| 5,823,289 | A | 10/1998 | Csomos |
| 5,979,172 | A | 11/1999 | Teller |
| 5,979,533 | A | 11/1999 | Dupuie |
| 6,173,930 | B1 | 1/2001 | Arbucci |
| 6,257,013 | B1 | 7/2001 | Murray et al. |
| 6,416,570 | B2 | 7/2002 | Goto et al. |
| 6,568,201 | B1 | 5/2003 | Cur et al. |
| 6,767,278 | B1 | 7/2004 | Peterson |
| 6,983,621 | B2 | 1/2006 | Cur et al. |
| 7,121,105 | B1 | 10/2006 | Rais |
| 7,296,424 | B2 | 11/2007 | Thompson |
| 7,332,019 | B2 | 2/2008 | Bias et al. |
| 7,350,759 | B1 | 4/2008 | Gray |
| 7,601,204 | B2 | 10/2009 | Woodruff et al. |
| 7,854,141 | B1 | 10/2010 | Breen |
| 7,896,957 | B2 | 3/2011 | Zhao et al. |
| 7,975,441 | B2 | 7/2011 | McCarriston |
| 8,091,844 | B1 | 1/2012 | Bragg |
| 8,104,240 | B2 | 1/2012 | McCarriston |
| 8,578,728 | B2 | 11/2013 | Cho et al. |
| 8,584,998 | B1 | 11/2013 | Peterson |
| 9,163,854 | B2 | 10/2015 | Arbuccci |
| 9,179,794 | B2 | 11/2015 | Darby |
| 9,303,895 | B1 | 4/2016 | Grant |
| 9,447,916 | B2 | 9/2016 | Darby et al. |
| D782,289 | S | 3/2017 | Darby et al. |
| 9,605,870 | B2 | 3/2017 | Darby et al. |
| 9,909,712 | B1 | 3/2018 | Darby |
| 9,938,044 | B2 | 4/2018 | Gamboa |
| 9,982,909 | B1 | 5/2018 | Perez et al. |
| 10,077,918 | B2 | 9/2018 | Darby et al. |
| 10,104,964 | B2 | 10/2018 | Darby |
| 10,203,130 | B2 | 2/2019 | Gardikis et al. |
| 10,203,180 | B2 | 2/2019 | Miller et al. |
| 10,295,221 | B2 | 5/2019 | Zhang |
| 10,359,212 | B2 | 7/2019 | Darby |
| 10,401,043 | B2 | 9/2019 | Li |
| 10,408,494 | B2 | 9/2019 | Darby |
| 10,520,206 | B2 | 12/2019 | Xu et al. |
| 10,775,054 | B2 | 9/2020 | Bradford et al. |
| 10,900,689 | B2 | 1/2021 | Weiner |
| 2001/0032545 | A1 | 10/2001 | Goto et al. |
| 2003/0097854 | A1 | 5/2003 | Cur et al. |
| 2003/0110789 | A1 | 6/2003 | Cur et al. |
| 2005/0028545 | A1 | 2/2005 | Herbert |
| 2006/0021359 | A1 | 2/2006 | Hur et al. |
| 2007/0023592 | A1 | 2/2007 | Makaso |
| 2007/0068185 | A1 | 3/2007 | Thompson |
| 2007/0137237 | A1 | 6/2007 | Rais |
| 2008/0053309 | A1 | 3/2008 | Woodruff et al. |
| 2008/0104989 | A1 | 5/2008 | Movshovitz |
| 2010/0077924 | A1 | 4/2010 | Zhao et al. |
| 2010/0197214 | A1 | 8/2010 | Geremia, Sr. et al. |
| 2010/0229585 | A1 | 9/2010 | Bradford et al. |
| 2010/0326103 | A1 | 12/2010 | Stamm et al. |
| 2012/0137499 | A1 | 6/2012 | Agniotri |
| 2012/0274188 | A1* | 11/2012 | Shiborino ..... F24F 1/56 312/100 |
| 2013/0104581 | A1 | 5/2013 | Consoli |
| 2013/0153744 | A1 | 6/2013 | Jin et al. |
| 2013/0327509 | A1 | 12/2013 | Michitsuji |
| 2014/0020421 | A1* | 1/2014 | Gallo ..... B23P 11/00 62/263 |
| 2014/0076506 | A1 | 3/2014 | Olivas |
| 2014/0090334 | A1 | 4/2014 | Darby et al. |
| 2014/0311063 | A1 | 10/2014 | McIntyre |
| 2015/0034784 | A1 | 2/2015 | Darby |
| 2015/0097096 | A1 | 4/2015 | Arbucci |
| 2015/0211802 | A1 | 7/2015 | Yokozeki et al. |
| 2015/0354838 | A1* | 12/2015 | Cur ..... F25B 39/00 62/426 |
| 2016/0033166 | A1 | 2/2016 | Herbert |
| 2016/0058189 | A1 | 3/2016 | Darby |
| 2016/0097547 | A1 | 4/2016 | Selg et al. |
| 2016/0298872 | A1 | 10/2016 | Darby et al. |
| 2017/0153041 | A1 | 6/2017 | Darby et al. |
| 2017/0159948 | A1 | 6/2017 | Darby |
| 2017/0191763 | A1 | 7/2017 | Xu et al. |
| 2017/0284683 | A1 | 10/2017 | Gallo et al. |
| 2017/0297768 | A1 | 10/2017 | Gamboa |
| 2017/0328596 | A1 | 11/2017 | Darby |
| 2018/0023842 | A1 | 1/2018 | Gardikis, Sr. et al. |
| 2018/0180305 | A1 | 6/2018 | Zhang |
| 2019/0056143 | A1 | 2/2019 | Zhang |
| 2019/0063760 | A1 | 2/2019 | Li |
| 2019/0212032 | A1 | 7/2019 | Galvan |
| 2020/0124296 | A1 | 4/2020 | Baumann et al. |
| 2020/0248911 | A1 | 8/2020 | Lei et al. |
| 2020/0333021 | A1 | 10/2020 | Galvan |
| 2020/0363075 | A1 | 11/2020 | Bradford et al. |
| 2021/0010688 | A1 | 1/2021 | Biasotti et al. |
| 2021/0078118 | A1 | 3/2021 | Li et al. |
| 2021/0088251 | A1 | 3/2021 | Martinez Galvan et al. |
| 2021/0180828 | A1 | 6/2021 | Xing et al. |
| 2021/0356146 | A1 | 11/2021 | Zhang et al. |
| 2021/0404749 | A1 | 12/2021 | Wexler et al. |

FOREIGN PATENT DOCUMENTS

| | | | |
|---|---|---|---|
| CN | 1338593 | A | 3/2002 |
| CN | 1445491 | A | 10/2003 |
| CN | 1595005 | A | 3/2005 |
| CN | 1727764 | A | 2/2006 |
| CN | 201104001 | Y | 8/2008 |
| CN | 201249077 | Y | 6/2009 |
| CN | 101523120 | A | 9/2009 |
| CN | 201589348 | U | 9/2010 |
| CN | 103471223 | A | 12/2013 |
| CN | 203379993 | U | 1/2014 |
| CN | 203501389 | U | 3/2014 |
| CN | 203518172 | U | 4/2014 |
| CN | 104061632 | A | 9/2014 |

(56) References Cited

FOREIGN PATENT DOCUMENTS

| | | | | | |
|---|---|---|---|---|---|
| CN | 203980467 | U | | 12/2014 | |
| CN | 204141751 | U | | 2/2015 | |
| CN | 204153874 | U | | 2/2015 | |
| CN | 204202053 | U | | 3/2015 | |
| CN | 204491248 | U | | 7/2015 | |
| CN | 205037425 | U | | 2/2016 | |
| CN | 205137735 | U | | 4/2016 | |
| CN | 106152315 | A | | 11/2016 | |
| CN | 106949559 | A | | 7/2017 | |
| CN | 206369283 | U | | 8/2017 | |
| CN | 107980091 | A | | 5/2018 | |
| CN | 109073269 | A | | 12/2018 | |
| DE | 4230604 | A1 | | 3/1994 | |
| EP | 0756140 | A2 | | 1/1997 | |
| EP | 1248049 | A2 | | 10/2002 | |
| EP | 1956307 | A1 | | 8/2008 | |
| EP | 2063192 | A1 | | 5/2009 | |
| FR | 755472 | A | | 11/1933 | |
| GB | 212669 | | | 3/1924 | |
| GB | 1239997 | | | 7/1971 | |
| GB | 2126695 | A | | 3/1984 | |
| GB | 2126695 | A | * | 3/1984 | ..... F24F 1/0003 |
| JP | 54105838 | A | | 8/1979 | |
| JP | 37248128 | A | | 9/1995 | |
| JP | 38226745 | A | | 9/1996 | |
| JP | 2001239121 | A | | 9/2001 | |
| JP | 2002357338 | A | | 12/2002 | |
| JP | 2009144984 | A | | 7/2009 | |
| JP | 2012132640 | A | | 7/2012 | |
| KR | 20070077917 | A | | 7/2007 | |
| KR | 20160086637 | A | | 7/2016 | |
| KR | 20160111687 | A | | 9/2016 | |
| KR | 102187381 | B1 | | 12/2020 | |
| KR | 20210077328 | A | | 6/2021 | |
| WO | 8800676 | A1 | | 1/1988 | |
| WO | 3190657 | A1 | | 11/2001 | |
| WO | 2005054751 | A2 | | 6/2005 | |
| WO | 2005116530 | A1 | | 12/2005 | |
| WO | 2009052372 | A2 | | 4/2009 | |
| WO | 2011079371 | A1 | | 7/2011 | |
| WO | 2012056164 | A1 | | 5/2012 | |
| WO | WO-2014188526 | A1 | * | 11/2014 | ..... F24F 1/16 |
| WO | 2014206846 | A1 | | 12/2014 | |
| WO | WO-2015098157 | A1 | * | 7/2015 | ..... F24F 1/38 |
| WO | 2015115929 | A1 | | 8/2015 | |
| WO | 2017001914 | A1 | | 1/2017 | |
| WO | 2017045909 | A1 | | 3/2017 | |
| WO | 2017045934 | A1 | | 3/2017 | |
| WO | 2017075658 | A1 | | 5/2017 | |
| WO | 2017194092 | A1 | | 11/2017 | |
| WO | 2018090114 | A1 | | 5/2018 | |
| WO | 2020038239 | A1 | | 2/2020 | |

OTHER PUBLICATIONS

WO-2015098157-A1 Translation (Year: 2015).*

Non Final Office Action for Application No. 16/771,111, dated Dec. 21, 2021, 41 pages.

International Preliminary Report on Patentability for International Application No. PCT/EP2017/082615, dated Jun. 16, 2020, 7 pages.

International Preliminary Report on Patentability for International Application No. PCT/EP2017/082611, dated Jun. 16, 2020, 7 pages.

International Search Report and Written Opinion for International Application PCT/EP2017/082615, dated Aug. 9, 10 pages.

International Search Report and Written Opinion for International Application PCT/EP2017/082611, dated Aug. 9, 2018, 10 pages.

Chinese Office Action for Chinese Application No. 201780097456.6, dated Jan. 6, 2021, with translation, 19 pages.

Chinese Office Action with Search Report for Chinese Application No. 201780097448.1, dated Jan. 12, 2021, 8 pages.

Chinese Office Action with Search Report for Chinese Application No. 201780097449.6, dated Jan. 12, 2021, 8 pages.

International Search Report and Written Opinion for International Application No. PCT/EP2016/062022, dated Jan. 23, 2017—9 pages.

Chinese Office Action for Chinese Application No. 2016800860880, dated May 7, 2020, 8 pages.

Chinese Office Action for Chinese Application No. 2016800860880, dated Jan. 26, 2021, with translation, 18 pages.

Non Final Office Action for U.S. Appl. No. 16/771,456, dated Nov. 10, 2021, 39 pages.

International Preliminary Report on Patentability for International Application No. PCT/EP2017/082610, dated Jun. 16, 2020, 5 pages.

International Search Report and Written Opinion for International Application PCT/EP2017/082610, dated Aug. 21, 2018, 7 pages.

"Evidence for Common Knowledge," 2014, 6 pages.

Chinese Office Action with Search Report for Chinese Application No. 201780097448.1, dated Jun. 29, 2021, with translation, 14 pages.

Chinese Office Action for Chinese Application No. 201680028498.X, dated Sep. 4, 2019, with translation, 15 pages.

Chinese Office Action for Chinese Application No. 201680085261.5, dated Apr. 14, 2020, 11 pages.

Chinese Office Action for Chinese Application No. 201680085261.5, dated Dec. 11, 2020, with translation, 28 pages.

European Communication pursuant to Article 94(3) for European Application No. 16 721 184.6, dated Oct. 7, 2020, 7 pages.

International Search Report and Written Opinion for International Application No. PCT/IB2016/000949, dated Nov. 2, 2016, 9 pages.

International Search Report and Written Opinion for International Application No. PCT/EP2016/060396, dated Jan. 24, 2017, 9 pages.

International Search Report and Written Opinion for International Application No. PCT/EP2016/070382, dated Dec. 1, 2016, 14 pages.

International Search Report and Written Opinion for International Application No. PCT/EP2016/070702, dated Dec. 9, 2016, 9 pages.

Final Office Action for U.S. Appl. No. 16/771,111, dated Apr. 19, 2022, 30 pages.

Non Final Office Action for U.S. Appl. No. 16/771,111, dated Sep. 8, 2022, 17 pages.

* cited by examiner

OUTDOOR UNIT OF AN AIR CONDITIONER

This application is a U.S. National Phase application of PCT International Application No. PCT/EP2017/082615, filed Dec. 13, 2017, which is incorporated by reference herein.

TECHNICAL FIELD

The invention relates to an air conditioner. In particular the present invention relates to a split air-conditioner and to the design of the outdoor unit of a split air conditioner.

BACKGROUND

Air conditioning is a collective expression for conditioning air into a desired state. It could be heating the air during cold periods, cooling the air during warmer periods or for cleaning the air if it contains unwanted particles. However, the expression air conditioning is most often used when emphasizing cooling. As a product, air conditioners can look and be used in various ways, but they all share the same basic technology. The air-conditioner comprises a compressor, a condenser, an evaporator, and typically also an expansion device.

There are different types of air-conditioners. One type of air-conditioner can be referred to as a split air-conditioner. In a split air conditioner, the condenser and the evaporator are located in two different separated units that are interconnected via pipes to circulate a refrigerant from one unit to the other.

Another type of air-conditioner can be referred to a Packaged Air Conditioner. A Packaged Air Conditioner (AC) can be said to be a type of self-contained system, in which all the cooling cycle components, such as the compressor, condenser, expansion device, evaporator and control system are enclosed in a single package. Among the packaged systems, the most commonly used for residential applications are the Window-type ACs, Packaged Terminal AC's (PTAC), and also Portable AC units.

The Packaged Air Conditioner has the advantages of easy installation, relatively small footprint, flexibility for heating/cooling individual rooms and low cost.

In contrast, Split Air Conditioners comprise at least two factory-made separated assemblies, designed to be used together. In a split system, the outdoor unit is separated by some distance from the indoor one(s) by means of semi rigid pipes which contain the refrigerant (at high pressure) that produces the cooling/heating effect in the system. Among other advantages, split systems can provide high efficiency ratios in a wide range of capacities and working conditions. Additionally, in split AC systems, the compressor, outdoor heat exchanger and outdoor fan can be located further away from the inside space, rather than merely on the other side of the same unit (as in PTACs or window air conditioners), achieving lower indoor noise levels.

There is a constant desire to improve air conditioners. Hence, there exists a need for an improved air conditioner.

SUMMARY

It is an object of the present invention—to provide an improved air-conditioner.

This object is obtained by an air conditioner as set out in the appended claims.

In accordance with the invention an outdoor unit of an air-conditioner is provided. The outdoor unit comprises a front air outlet and at least one air inlet. The outdoor unit further comprises at least one fan. The outdoor unit is configured such that the at least one air inlet is provided in the top section and or in the bottom section of the outdoor unit when the outdoor unit is installed in an operational position. The outdoor unit is further configured such that the at least one fan is configured to move air from the at least one air-inlet to the front air outlet or move air from front air outlet to the at least one air-inlet. Hereby it is achieved that the air can be moved through the outdoor unit without having to pass through the backside of the outdoor unit. This makes it possible to install the outdoor unit close to or directly on the outside wall of a building to facilitate installation.

In accordance with one embodiment, a compressor can be located in the center-back of the structure of the outdoor unit. Hereby a good weight distribution can be obtained also air can pass through the middle of the outdoor unit.

In accordance with one embodiment, a liquid-to-refrigerant heat exchanger can be located in the back side of the structure of the outdoor unit. Hereby a good weight distribution can be obtained also air can pass through the middle of the outdoor unit.

In accordance with one embodiment, an electronic and control box can be located in the back side of the structure of the outdoor unit. Hereby a good weight distribution can be obtained also air can pass through the middle of the outdoor unit.

In accordance with one embodiment, an air to refrigerant heat exchanger can be located at the front side of the structure of the outdoor unit. Hereby air can pass through the middle of the outdoor unit.

In accordance with one embodiment, a free space for air circulation between the backside of the structure of the outdoor unit and the air to refrigerant heat exchanger is provided. Hereby air can pass freely to the air to refrigerant heat exchanger.

In accordance with one embodiment, the outdoor unit comprises at least two fans. In particular two axial fans can be used. Hereby an improved airflow in the outdoor unit can be provided.

In accordance with one embodiment, a grill can be provided in the bottom section of the structure of the outdoor unit. Hereby air can be made to pass the bottom section of the outdoor unit and at the same time provide a base for the components inside the structure of the outdoor unit.

In accordance with one embodiment, the top section of the structure of the outdoor unit can be closed. Hereby the components of the outdoor unit can be made less exposed to rain and snow or similar.

The invention also extends to an air-conditioner comprising an outdoor unit as set out above.

BRIEF DESCRIPTION OF THE DRAWINGS

The invention will now be described in more detail, by way of example, and with reference to the accompanying drawings, in which.

DETAILED DESCRIPTION

The invention will now be described more fully hereinafter with reference to the accompanying drawings, in which certain embodiments of the invention are shown. The invention may, however, be embodied in many different forms and should not be construed as limited to the embodiments set forth herein; rather, these embodiments are provided by way of example so that this disclosure will be thorough and complete, and will fully convey the scope of the invention to those skilled in the art. For example, like or similar components of different embodiments can be exchanged between different embodiments. For example, the outdoor unit can be a conventional outdoor unit for a split air-conditioner and not an outdoor unit as described herein. Some components can be omitted from different embodiments. Like numbers refer to like elements throughout the description.

As has been realized by the inventor, conventional air-conditioners of a split type are difficult and often expensive to install. Also, conventional systems require much space. It would therefore be advantageous to provide a split air-conditioner that can be easily installed and which is more compact than conventional split air-conditioners.

Figure 1:
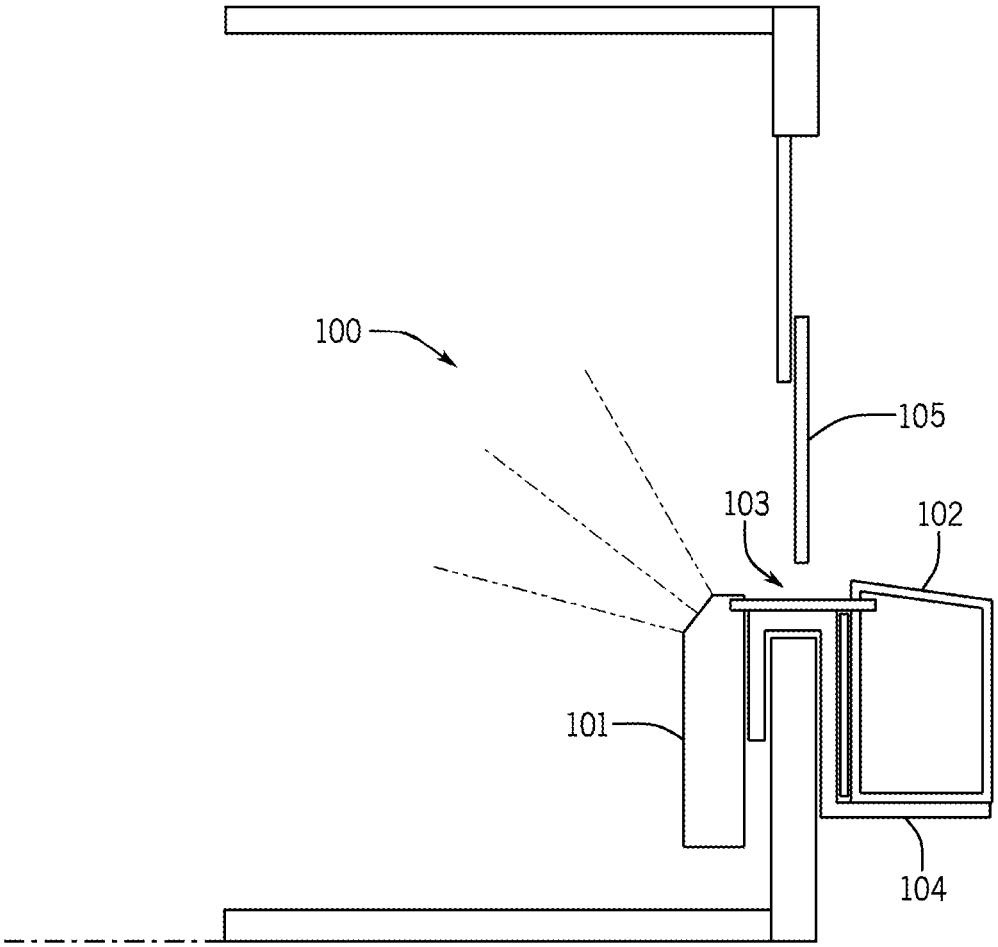
FIG. 1 shows a general view of an AC installation through a window opening.

FIG. 1 shows a schematic diagram of an embodiment of an air-conditioner 100. The air-conditioner 100 can be said to be of a split type comprising an indoor unit 101 and a packaged outdoor cooling unit 102. The units 101, 102 are interconnected via an intermediate connection system 103. Further, a mechanism 104 for installation of the air conditioner 100 is depicted. Also depicted is a window 105 where the air-conditioner 100 is installed. In this exemplary embodiment the window 105 is a standard hung type window. The air conditioner as described herein can also be installed in other type of windows such as a sliding window or some other openable window. To enable a compact installation of the outdoor unit 102, the outdoor unit can be provided with a fan arrangement that moves air from the top/bottom of the outdoor unit and out via a front air outlet. This makes it possible to install the outdoor unit closer to the outside wall where the outdoor unit is located. Other advantages can also be obtained as is set forth herein.

Figure 2:
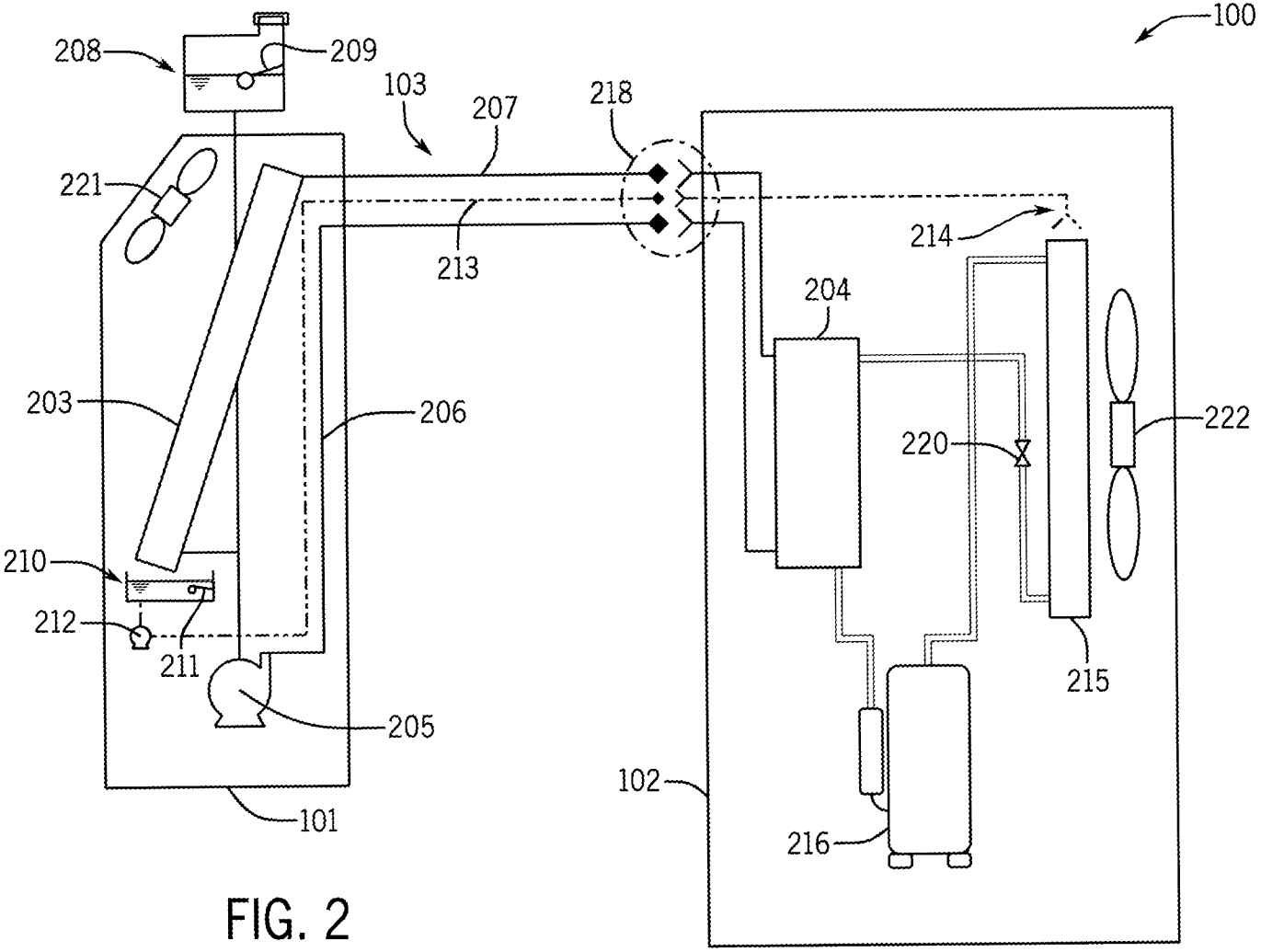
FIG. 2 illustrates a type of a split air conditioner with an outdoor unit.

In FIG. 2, an air-conditioner 100 with an outdoor unit comprising a packaged refrigeration system is described. However, it is to be understood that an outdoor unit not having a packaged refrigeration system also can use the working principles of the fan configuration and other features as set out herein. For example, a conventional split air-conditioner could be provided with an outdoor unit using the technology as described herein. Thus, it is to be understood that the embodiment of FIG. 2 is for illustrational purposes to illustrate an installation where the invention can be used.

In FIG. 2, an exemplary implementation of the split type air-conditioner 100 of FIG. 1 is shown in more detail. FIG. 2 shows the indoor unit 101, and the outdoor unit 102. The indoor unit comprises an air-to-liquid heat exchanger 203. The air-to-liquid heat exchanger 203 cools (or heats) the air flowing in the indoor unit 101. Further, a liquid to refrigerant heat exchanger, in particular a compact liquid-to-refrigerant heat exchanger 204 is provided in the outdoor unit 102. The compact liquid-to-refrigerant heat exchanger 204 works as an evaporator. Further a main pump 205 is provided to circulate a liquid solution used as an energy transport media from the indoor unit 101 to the outdoor unit 102 (and back again). The main pump can equally be located in the outdoor unit 102. The liquid solution is circulated via the connection system 103. In this example the connection system 103 is formed by two connection pipes 206 and 207. Since, the connection system 103 can be made to work at relatively low pressure (around 1 bar), the pipes 206 and 207 can alternatively be hoses or similar devices that are easy to handle and can be provided with connectors that can withstand a low pressure. The outdoor unit 102 further comprises a refrigeration system, comprising a compressor 216 driving a refrigerant via that an air-cooled heat exchanger 215 via an expansion valve 220 and the compact liquid-to-refrigerant heat exchanger 204 back to the compressor 216. The refrigeration system of the outdoor unit can be factory installed such that the user or installer does not have to work with the circuit circulating the refrigerant. The refrigerant circulated via the air-cooled heat exchanger 215 can then be filled in the factory. There will then be no need to handle a refrigerant during installation, because the refrigerant circuit of the outdoor unit 102 is factory sealed.

Further, a liquid tank 208 can be located on the top of the system. The liquid tank 208 can be connected to the circuit circulating the energy transport media. In accordance with one example the liquid tank can be connected to the suction port of the main pump 205. The tank 208 can include a level sensor 209 for controlling the amount of liquid solution circulated between the indoor unit 101 and the outdoor unit 102 needed for proper operation of the system 100. A box 210 can be provided under the indoor heat exchanger 203 for collecting any condensate that is generated on the indoor heat exchanger 203. A sensor 211 can be provided to detect the water level inside of the condensate box 210. The sensor 211 can generate a signal that can be used to control a condensate water pump 212. When activated the water pump 212 is adapted to pump water from the box 210 to outside of the indoor unit 101. In particular water can be pumped outside of the building where the indoor unit is mounted to be released on the outside. Hereby an arrangement that can pump condensate water from the indoor unit 101 to the outside is obtained.

In accordance with some embodiments the water is pumped to the outside unit 102. The pumped water can then for example be pumped through a drainage line 213 towards a spray device 214 located on the top of the outdoor air-cooled heat exchanger 215, which is connected to the compressor 216.

FIG. 2 further depicts a fan 221 provided in the indoor unit 101 for circulating air in the indoor unit. Also, a fan 222 is provided in the outdoor unit for circulating air in the outdoor unit 102. The connection system 103 can further be provided with a connection device 218. The connection device 218 can for example be a quick connection to in a quick and safe manner interconnect the piping of the indoor unit 101 with the piping of the outdoor unit 102. The connection device can advantageously be located on the top part of the outdoor unit. By connecting the indoor unit 101 with the outdoor unit 102, an energy transport media can be circulated between the indoor unit 101 and the outdoor unit 102. Also, condensate water can be transported from the indoor unit to the outdoor unit 102 via the connection system 103.

In use, the air conditioner 100 decreases the temperature of the energy transport media using the external packaged AC device of the outdoor unit 102. The cooling effect is produced in the compact heat exchanger 204 located in the refrigeration system of the outdoor-unit 102, allowing in turn a temperature drop of the energy transport media, which is then transported in to the indoor unit 101 via the connection system 103. Then, the energy transport media at lower temperature absorbs the thermal energy from the space to be conditioned, by using the low-pressure air-to-liquid heat exchanger 203 of the indoor unit 101. Heat is then returned from the inside unit 101 to the outside unit 102 by returning the energy transport media to the outside unit when having being heated in the indoor unit 101 that is installed in the indoor space to be conditioned.

Because the cooling capacity production is isolated to the refrigeration circuit located in the outdoor unit 102 all heavy and noisy components can be confined to the outside unit and the indoor environment can be close to free of noise. Also, there is very little space required for the indoor unit. Because the connection system 103 used to transfer heat between the indoor unit 101 system can be a low-pressure system it can use an energy transport media that is easy to handle, such as water a water based solution, or some other liquid media such as ethanol.

Thus, in accordance with some embodiments, an aqueous media can be used to transport the energy from the indoor space to be conditioned to the compact evaporator located in the external packaged device. The main pump 205 will ensure the flow of the energy transport media by pumping the aqueous media, and the external cooling unit will reject the heat generated in the process to the ambient outdoor air.

This is made possible since the external, packaged cooling system located in the outdoor unit can comprise all the standard constitutive elements in a refrigeration system, such as compressor, condenser, expansion device, evaporator and control system, and refrigerant.

Figure 3A:
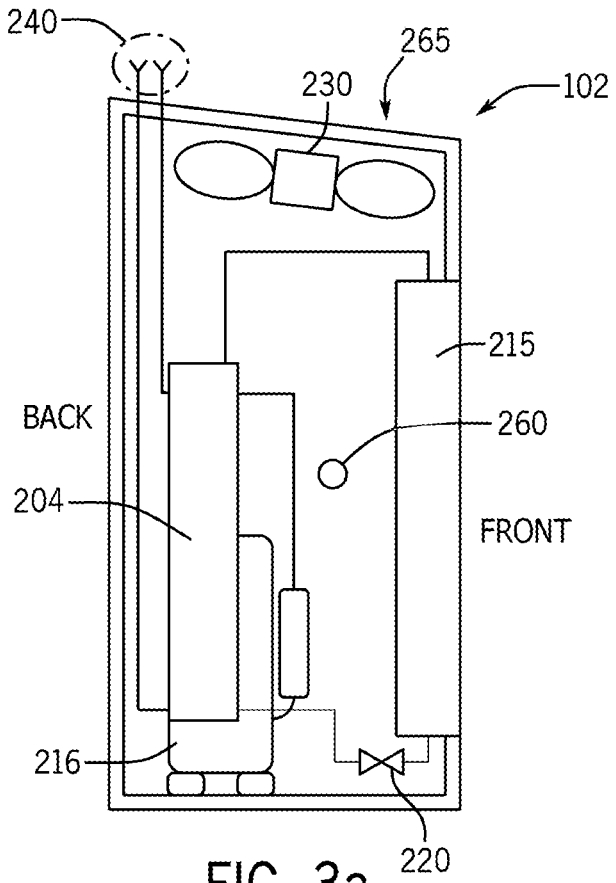
FIGS. 3*a* and 3*b* illustrates location of components in an outdoor unit.
Figure 3B:
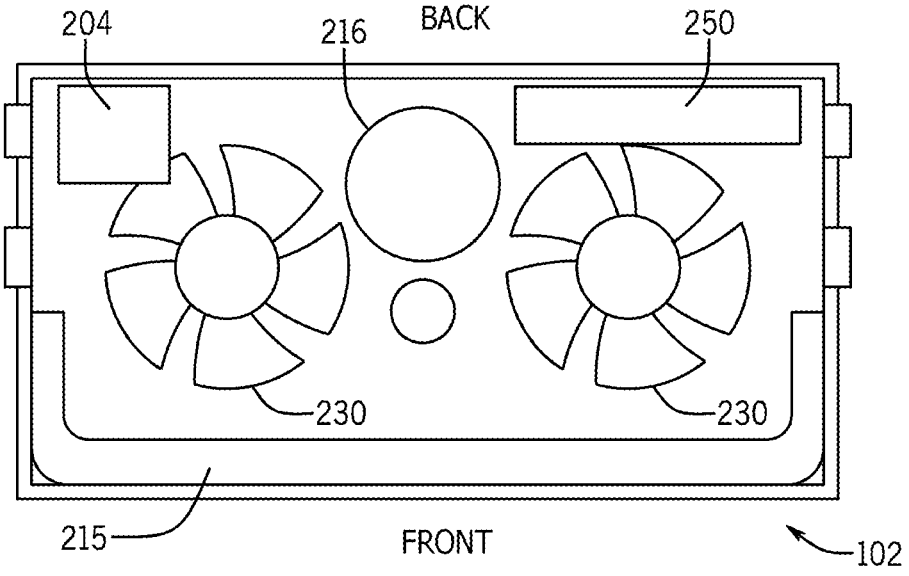

In FIG. 3, an exemplary outdoor unit 102 of a type similar to the embodiment of FIG. 2 is shown. FIG. 3 shows a sectional view from the side to the right and a sectional top view to the right. The outdoor unit 102 has a structure 265 wherein the components of the outdoor unit are located. The structure 265 can generally have a top section, a bottom section and a casing for protecting the components inside the structure of the outdoor unit. In FIG. 3, a compressor 216 is provided. In this exemplary embodiment, the compressor drives a refrigerant via an air-cooled heat exchanger 215 via an expansion valve 220 and a compact refrigerant-to-liquid heat exchanger 204 back to the compressor 216. Further, a fan 230 is provided. In the embodiment the fan 230 is implemented by two axial fans. Other types of fans could also be used such as a radial fan. The outdoor unit 102 can be connected to an indoor unit via the connectors 240. An electronic and control box 250 can be provided to implement the control mechanism of the outdoor unit 102. Also, a free space 260 for air circulation is indicated in FIG. 3. The fan 230 is arranged to move air in the outdoor unit such that air does not have to pass through the back-side of the outdoor unit when the outdoor unit is mounted close to a wall. Hereby it is made possible to mount the outdoor unit very close to or even directly on a wall, since no air has to pass the back-side of the outdoor unit 102. This can make installation easier and also there is less space required for installing the outdoor unit. An additional advantage can be that the load on the arrangement used for securing the outdoor unit can be reduced.

As is seen in FIG. 3 in the left view, the compressor 216 can be located at the back-side of the outdoor-unit 102, i.e. the side facing the wall when the outdoor unit is mounted at a wall. The compressor 216 can also be placed centrally in a sideway direction. Thus, in accordance with one embodiment the compressor is located centrally at the backside of the outdoor unit when the outdoor unit is mounted on a wall.

Further, in accordance with some embodiments, a compact refrigerant—to liquid heat exchanger 204 can be located at the backside of the outdoor-unit. Also, the electronic and control box 250 can be located at the back-side. This makes it possible to locate an air-to-refrigerant heat exchanger 215 and a fan 230 in the remaining space of the outdoor unit allowing air to pass through the air-to-refrigerant heat exchanger 215. Air can be blown through the air-to-refrigerant heat exchanger 215 by the fan 230 from the top-section and/or the bottom section of the outdoor unit 102. The air-to-refrigerant heat exchanger 215 can thus be placed in the interior part the casing, just in front of the rest of components, with a separation between them that creates a free channel where the air can cross the air-to-refrigerant heat exchanger 215 and flow with a low restriction. In accordance with some embodiments, the fan 230 that drive the air flow can be placed on the top of the outdoor unit 102.

Since the compressor 216 is normally the heaviest component of the system, a location thereof at the center-back of the structure, ensures a balanced system with respect to the width of the unit. In a conventional air-conditioner it is often the case that the outdoor unit has a heavier side, which corresponds to the side where the compressor is located. This makes it difficult to transport and install a conventional outdoor unit.

Furthermore, the location of many of the heavy components as exemplified above at the back side of the outdoor unit will provide an outdoor unit 102 with a center of gravity located in the low center-back of the outdoor unit 102. This will provide an equilibrated and steady structure for the outdoor unit 102.

Figure 4A:
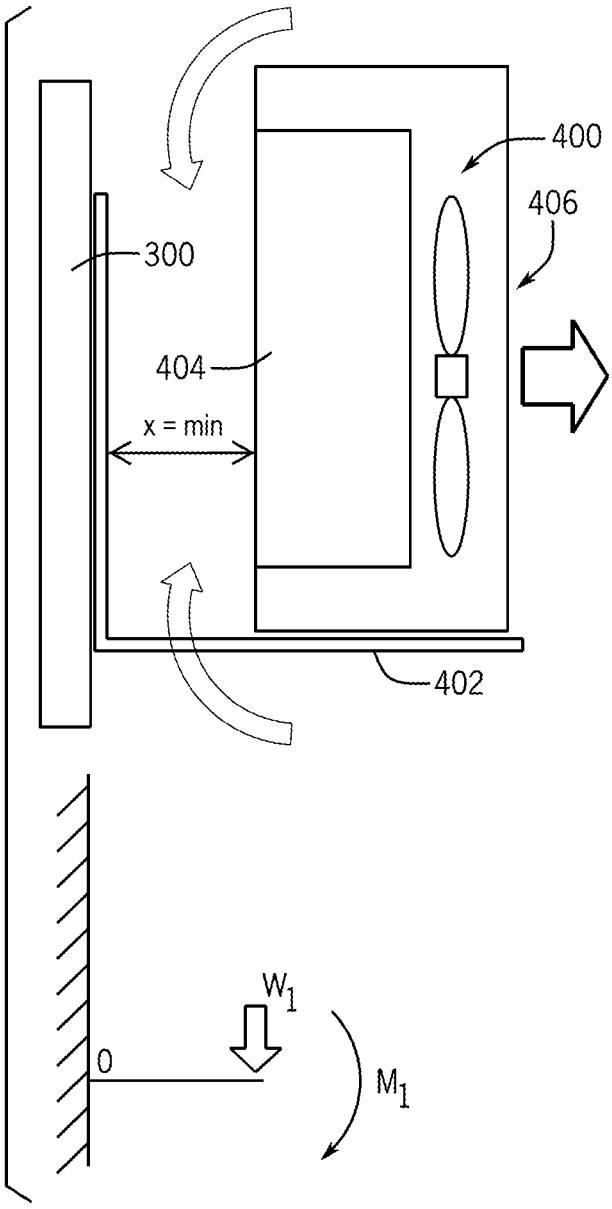
FIGS. 4*a* and 4*b* are comparative views of an installation of a conventional outdoor unit and an outdoor unit in accordance with an embodiment of the invention.
Figure 4B:
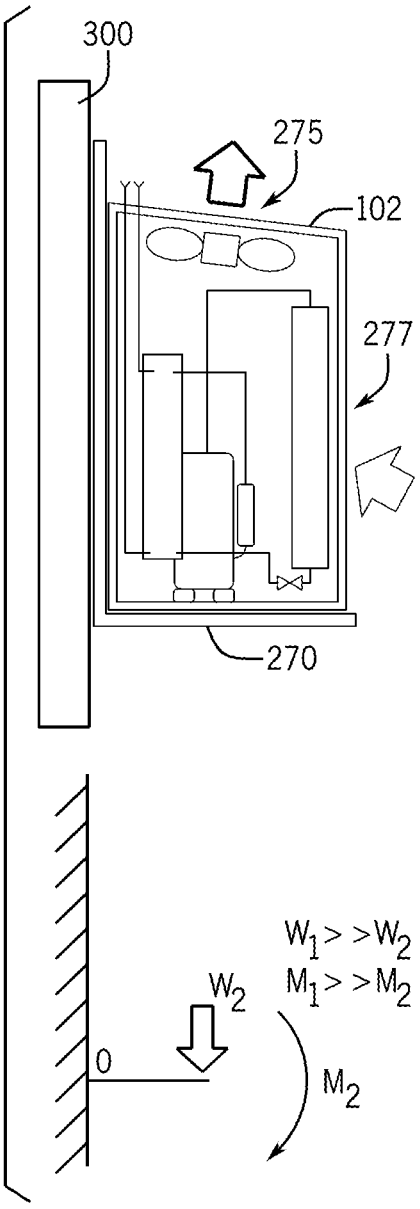

FIG. 4*a* shows the layout of a standard outdoor unit. FIG. 4*b* shows the layout of an outdoor unit in accordance with the teachings herein. In FIG. 4*a*, a standard outdoor split AC unit 400 is shown. FIG. 4*a* further shows the structure 402 needed to support the outdoor unit 400. The structure 402 is mounted on a wall 300. The outdoor unit 400 has a backside air intake 404 facing the wall surface. The outdoor unit 400 further has an air exhaust 406 located on the front side of the outdoor unit 400. In FIG. 4*b* an outdoor unit 102 having a fan arrangement in accordance with the teachings herein is shown. In FIG. 4*b*, a structure 270 that supports the outdoor unit 102 is provided. The structure 270 is mounted on a wall 300. The outdoor unit 102 has a top side air intake 275. The outdoor unit 102 further has an air outlet 277 intake located on the front side of the outdoor unit 102.

In a configuration as depicted in FIG. 4*a*, a minimum distance between the wall and the air intake area of the outdoor unit 400 is required to ensure its proper operation. A typical minimum distance to the wall 300 is between 15 cm to 30 cm. On the other hand, the layout of the outdoor unit 102 described herein, does not need any separation between the outdoor unit 102 and the wall 300. As a result of that, the weight supported by the structure 270 ($W_2$) and the resulting momentum ($M_2$) is much smaller compared to the corresponding values for the structure 402 of a conventional outdoor unit 400 having to cope with a higher weight ($W_1$) and a higher Momentum ($M_1$).

The air flow path can be configured in accordance with some different alternatives. In FIGS. 5*a*-5*d*, different embodiments that can be used for different configurations are depicted.

Figure 5A:
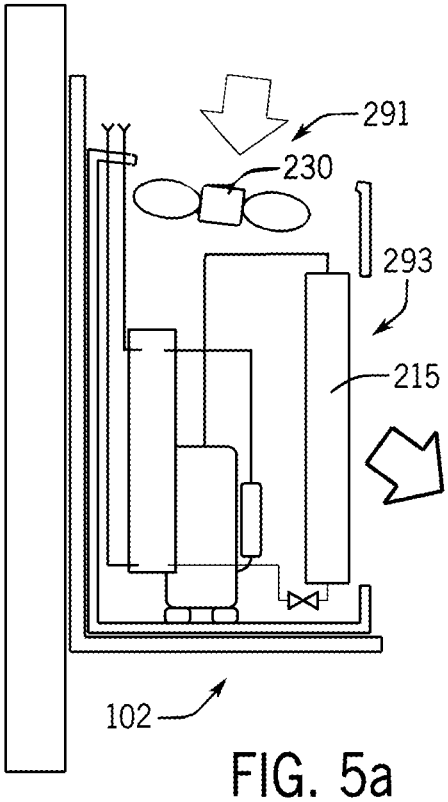
FIGS. 5*a*-5*d* illustrate different fan configuration for moving air in an outdoor unit.
Figure 5B:
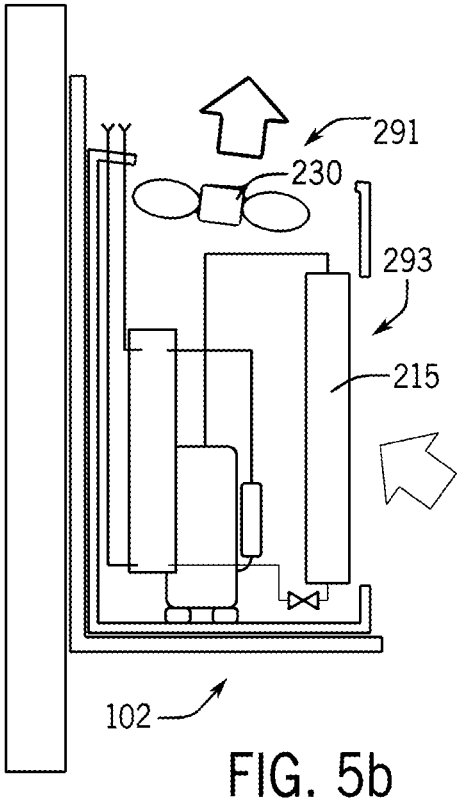

In accordance with the embodiment of FIG. 5*a*, a design where the fan push air and where the fan is located at the top section of the outdoor unit 102 is shown. In such a configuration as is shown in FIG. 5*a* the air inlet 291 is located at the top of the outdoor unit 102 and air is pushed through the heat exchanger 215 to the air exit the outdoor unit in an outlet 293 in the front of the outdoor unit 102. The fan 230 can also be driven in the reverse direction. The fan 230 will then suck air via the heat exchanger 215 to be blown out at the top section of the outdoor unit 102. Such a configuration is shown in FIG. 5*b*.

Figure 5C:
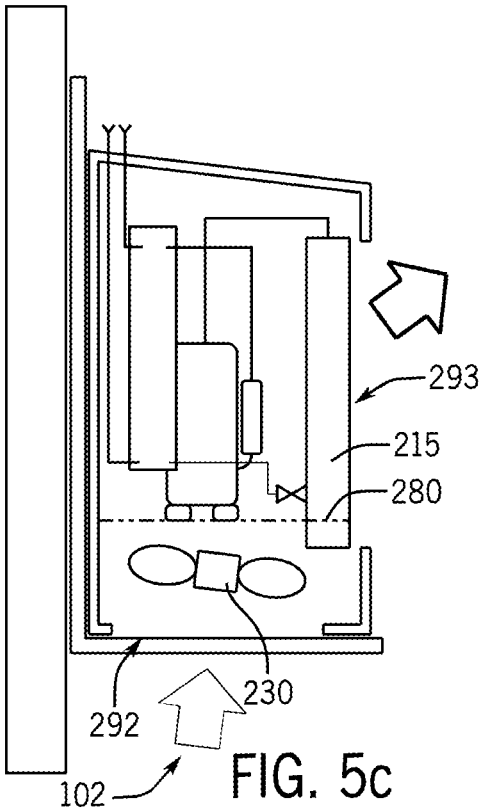
Figure 5D:
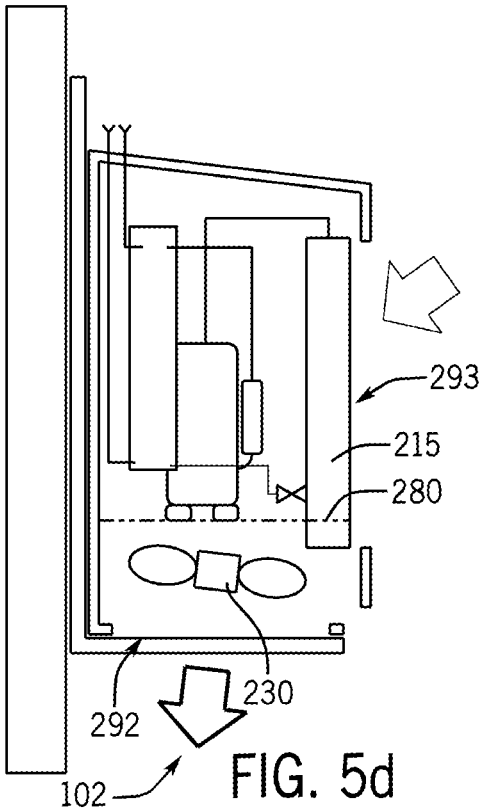

In some embodiments, air can enter/exit the outdoor unit 102 via the bottom section of the outdoor unit. In FIG. 5*c* a design where the components inside the outdoor unit are placed on a base formed by a grill 280 that allows air to enter from under the outdoor unit. The fan 230 is then located at the bottom section of the outdoor unit 102 to push air from an inlet 292 in the bottom section via the heat exchanger 215 out through an outlet 293 in the front of the outdoor unit 102. The fan at the bottom of the outdoor unit 102 shown in FIG. 5*c* can also be run in the opposite direction to draw air from the front section of the outdoor unit 102 via the heat exchanger 215 out through the bottom of the outdoor unit 102. Such a configuration is shown in FIG. 5*d*. When the outdoor unit is open in the bottom section, the top section can be closed.

In accordance with some embodiments two fans 230 can be used to provide the air flow in the outdoor unit 102. By using two fans, the air flow needed in the heat rejection process can be ensured with a more homogeneous air distribution over the whole heat transfer area of the condenser(s), allowing in turn the use a smaller condenser, due to an improved heat transfer process. In accordance with one embodiment, two fans are mounted on the top of the outdoor unit when mounted on a wall. In an alternative embodiment two fans are mounted at the bottom of the outdoor unit when mounted on a wall. In yet an alternative embodiment fans 230 are located at both the top and the bottom and air enters/exits the outdoor unit 102 both at the top section and the bottom section. In other words, air can be draw via heat the exchanger 215 to exit both at the top and the bottom section or pushed in the opposite direction. In such embodiments fans 230 can be provided both at the top section and the bottom section of the outdoor unit.

The outdoor unit as described herein can be made very compact and have relatively low weight. For example, the height can be 400 to 600 mm, the width can be 500 to 650 mm and the depth can be 280 to 330 mm. Further the weight can be less than 30 kg.

The invention claimed is:

1. An outdoor unit of an air-conditioner, the outdoor unit comprising:

a casing extending from a top section to a bottom section and having a front air outlet located vertically between the top section and the bottom section;

a compressor located in the casing at a back side of the casing opposite the front air outlet in a space directly between the front air inlet and the back side of the casing;

at least one air inlet into the casing; and at least one fan located inside the casing;

wherein the at least one air inlet is provided in the top section and/or in the bottom section of the outdoor unit when the outdoor unit is installed in an operational position, and wherein the at least one fan is configured to move air from the at least one air-inlet to the front air outlet or move air from the front air outlet to the at least one air-inlet.

2. The outdoor unit in accordance with claim 1, further comprising a liquid-to-refrigerant heat exchanger located in the casing at a back side of the casing opposite the front air outlet.

3. The outdoor unit in accordance with claim 1, further comprising an electronic and control box located in the casing at a back side of the casing opposite the front air outlet.

4. The outdoor unit in accordance with claim 1, further comprising an air to refrigerant heat exchanger located in the casing at a front side adjacent the front air outlet.

5. The outdoor unit in accordance with claim 4, further comprising a free space for air circulation located in the casing between a back side of the casing opposite the front air outlet and the air to refrigerant heat exchanger.

6. The outdoor unit in accordance with claim 1, comprising at least two fans.

7. The outdoor unit in accordance with claim 6, wherein the at least two fans comprises two axial fans.

8. The outdoor unit in accordance with claim 1, further comprising a grill in the bottom section of the casing.

9. The outdoor unit in accordance with claim 1, wherein the entire top section of the casing is closed.

10. An air-conditioner comprising the outdoor unit according to claim 1.

11. The outdoor unit in accordance with claim 1, further comprising a liquid-to-refrigerant heat exchanger located in the back side of the casing.

12. The outdoor unit in accordance with claim 2, further comprising an air to refrigerant heat exchanger located in the casing at a front side adjacent the front air outlet.

13. The outdoor unit in accordance with claim 12, further comprising a free space for air circulation located in the casing between the liquid-to-refrigerant heat exchanger and the air to refrigerant heat exchanger.

14. The outdoor unit in accordance with claim 1, wherein the compressor is located in the center-back of the casing.

* * * * *